US008561779B2

(12) United States Patent
Meyer et al.

(10) Patent No.: US 8,561,779 B2
(45) Date of Patent: Oct. 22, 2013

(54) BOX CARRIER

(75) Inventors: Peter Meyer, Beringen (CH); Alexander Hering, Neuhausen am Rheinfall (CH)

(73) Assignee: Robert Bosch GmbH, Stuttgart (DE)

( * ) Notice: Subject to any disclaimer, the term of this patent is extended or adjusted under 35 U.S.C. 154(b) by 125 days.

(21) Appl. No.: 12/809,939

(22) PCT Filed: Oct. 24, 2008

(86) PCT No.: PCT/EP2008/064406

§ 371 (c)(1),
(2), (4) Date: Jun. 21, 2010

(87) PCT Pub. No.: WO2009/077250

PCT Pub. Date: Jun. 25, 2009

(65) Prior Publication Data

US 2010/0263986 A1 Oct. 21, 2010

(30) Foreign Application Priority Data

Dec. 19, 2007 (DE) ..... 10 2007 061 095

(51) Int. Cl.
*B65B 43/52* (2006.01)
*B65G 17/46* (2006.01)

(52) U.S. Cl.
USPC ..... 198/339.1; 198/471.1

(58) Field of Classification Search
USPC ..... 198/471.1
See application file for complete search history.

(56) References Cited

U.S. PATENT DOCUMENTS

| | | | | |
|---|---|---|---|---|
| 3,302,803 | A | 2/1967 | Mooney | |
| 3,698,451 | A | 10/1972 | Hudson | |
| 3,701,414 | A * | 10/1972 | Mayer et al. | 198/832.2 |
| 3,880,272 | A * | 4/1975 | Huck | 198/468.4 |
| 4,628,665 | A * | 12/1986 | Herrington | 53/252 |
| 5,191,967 | A * | 3/1993 | Woltjer et al. | 198/781.06 |
| 5,727,365 | A * | 3/1998 | Lashyro et al. | 53/448 |
| 6,354,203 | B2 * | 3/2002 | Backer et al. | 101/232 |
| 6,422,377 | B1 * | 7/2002 | Ulrich | 198/689.1 |
| 7,650,984 | B2 * | 1/2010 | Giuliani et al. | 198/471.1 |
| 2006/0075725 | A1 | 4/2006 | Komp | |

FOREIGN PATENT DOCUMENTS

| | | | |
|---|---|---|---|
| DE | 3941866 | A1 | 6/1991 |
| DE | 19753226 | A1 | 6/1998 |
| DE | 19731902 | A1 | 1/1999 |
| DE | 19847249 | A1 | 4/2000 |
| DE | 69805004 | T2 | 10/2002 |
| DE | 10122032 | A1 | 11/2002 |
| DE | 102006008646 | A1 | 8/2007 |
| EP | 1433706 | A1 | 6/2004 |
| EP | 1645512 | A1 | 4/2006 |
| JP | 04064595 | A * | 2/1992 |
| JP | 2000190902 | A | 7/2000 |
| WO | 9725246 | A1 | 7/1997 |

* cited by examiner

*Primary Examiner* — Kavel Singh
(74) *Attorney, Agent, or Firm* — Michael Best & Friedrich LLP

(57) ABSTRACT

The invention relates to a box carrier having a contact surface for transporting flat cutouts, or sleeves, and folding boxes produced from the same. According to the invention at least one suction opening, which can be connected to a vacuum source, is disposed in the contact surface.

22 Claims, 3 Drawing Sheets

BOX CARRIER

CROSS-REFERENCE TO RELATED APPLICATION

This application is a 35 USC 371 application of PCT/EP2008/064406 filed on Oct. 24, 2008.

BACKGROUND OF THE INVENTION

1. Field of the Invention

The invention relates to a box carrier having a contact surface for transporting flat blanks and sleeves and folding boxes from them.

2. Description of the Prior Art

Conventional transportation systems for boxes are usually based on box carriers with mechanical clamping of the boxes. The carriers can each transport one box format or package style, and converting to new formats involves a considerable expenditure of time. Often, format-specific parts of the mechanical box mounts have to be replaced. These interventions mean a drop in production from stoppage of the machine and have the potential for mistakes in the setup or setting, which is problematic above all in the pharmaceutical industry. The setup time is especially long in variants that have replaceable box carriers, while mere settings, although they require less time, nevertheless have a high potential for error. A further disadvantage of holding boxes mechanically by means of clamping is the unavoidable deformation of the boxes that occurs, which makes closing of the boxes while they're being held by the box carrier more difficult.

As a universally usable alternative to the box carriers with mechanical clamping, vacuum belts are known, which are capable of processing various box formats without conversion. However, vacuum belts are distinguished by poor precision and cannot reliably prevent unintentional shifting of the boxes while they are being transported. Vacuum belts are therefore unsuitable for use particularly in the pharmaceutical field.

OBJECTS AND ADVANTAGES OF THE INVENTION

The object of the invention is to create a box carrier of the type defined at the outset that does not have the aforementioned disadvantages.

A further object of the invention is to furnish a box carrier for transporting boxes for packaging pharmaceutical products, in particular, in a packaging machine.

It leads to the inventive attainment of this object that at least one suction opening that can be connected to a vacuum source is disposed in the contact surface.

The disposition according to the invention of suction openings in the contact surface offers the following advantages, in comparison to the embodiments offered in the prior art:

No format conversions for different box formats are necessary.

The carrier is equally suitable for sleeves and flat blanks.

Secure hold because of high retention forces and secure positioning of the boxes, since no shifting is possible in the carrier.

No deformation of the boxes from retention forces.

Good accessibility; the boxes are held essentially only by one side, while the other sides are essentially freely accessible.

The boxes can be closed while they are located in the box carrier, since they do not undergo deformation.

The good accessibility makes the imprinting/coding the boxes and comparable operations easier.

High security, since not vulnerable to mishandling.

Aspirating the boxes by means of a vacuum has decisive advantages in terms of ergonomics and format adaptation. The good ergonomics and the ease of use are the primary advantages in the use of the invention. The downtime of the machine for the format conversion is shortened, and possible sources of mistakes are reduced to a minimum. The fact that no special knowledge on the part of the user is necessary for the format conversion is also important.

A highly flexible, universally usable transportation system is available, which makes it possible to package various products on one and the same machine, without much effort being expended upon a change of format. In particular, all the format ranges are covered, and no format parts are necessary, and the box carriers have an only slight weight. Furthermore, practically automatic format conversion ensues; the boxes can be erected in the cup, and practically no compression or deformation of the boxes occurs.

Because compression and deformation is precluded, the boxes can already be closed in the box carrier; additional processing steps, such as labeling and coding the boxes, are also equally possible because of the high accessibility on all sides.

The box carriers can have a position stop. A stop on side defines the position of the boxes.

The contact surface of the box carrier preferably has a plurality of suction openings. Suction openings equipped with a valve, in particular a touch valve, are expedient in this respect. By the use of touch valves, which open only when a box is in contact with them, even blanks that do not cover all the suction openings can be held without air being aspirated through the suction openings that are not covered. It is thus assured that the underpressure in the box carrier is not diminished by air flowing in. The size and spacing of the suction openings are selected such that for the box formats to be processed, no suction openings that are only partly covered can occur.

Preferably, each box carrier is equipped with its own vacuum reservoir that communicates with the suction openings.

Sleeves, that is, boxes with side walls that are tall in proportion to the bottom area, are retained on one side wall; thus the stop face that has the suction openings is perpendicular to the circulation plane of the transporting mechanism.

Flat blanks with a low side wall height in proportion to the bottom area are carried, given a horizontal box carrier, by the horizontally oriented contact surface and are accordingly held from beneath. In a practical way, the box carrier is designed such that a conversion from sleeves to flat blanks can be made by simply rotating the box carrier by 90°.

Box carriers with their own vacuum reservoir, for venting and ventilating the vacuum reservoir in a venting and ventilating station, are preferably equipped with a touch check valve. As a result, it is possible to dispense with delivering the requisite vacuum or underpressure to the circulating box carriers, something that involves major effort. The box carriers provided with vacuum reservoirs are subjected to a vacuum only at points along the circuit intended for that. After that, the box carrier is uncoupled and maintains the negative pressure on its own with the aid of its vacuum reservoir.

Further advantages, characteristics and details of the invention will become apparent from the ensuing description of preferred exemplary embodiments and from the drawings, in which.

DESCRIPTION OF THE PREFERRED EMBODIMENTS

Figure 1:
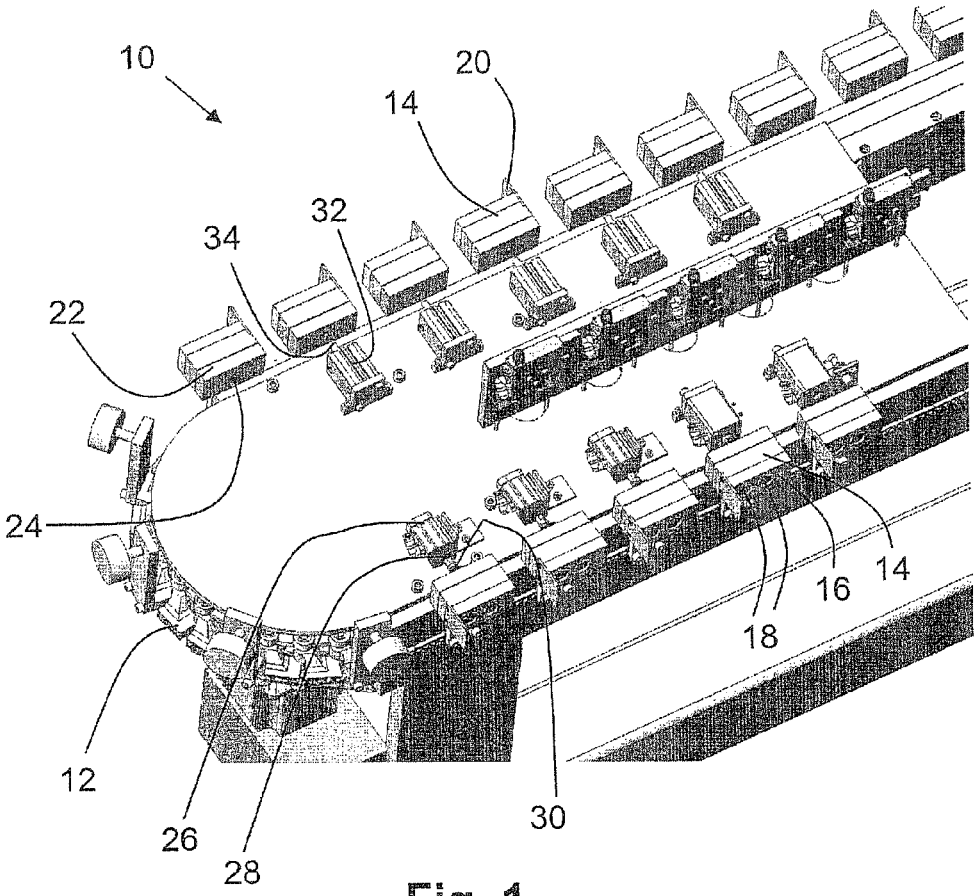
FIG. 1 shows an oblique view on a portion of a circulating machine with circulating box carriers.

A circulating system 10, shown only in part in FIG. 1, of a packaging machine not shown in further detail in the drawings has a plurality of box carriers 14, disposed on a conveyor chain 12 revolving endlessly in a horizontal plane, and the box carriers have a contact surface 16, forming a front side and having two suction openings 18, and a position stop 20 for a folding box. A vacuum reservoir 22 with an integrated touch check valve 24 is disposed on the back side of the box carriers 14.

The circulating system 10 has five venting stations 26 with lifting suction devices for simultaneous evacuation of the vacuum reservoir 22 of five box carriers 14. For venting the vacuum reservoir 22, the lifting suction devices of the venting station 26 dock at the venting positions via a suction line 28 on the back side of the box carrier 14 above the outlet of the touch check valve 24, and a suction cup 30 disposed on the free end of the suction line 28 attaches firmly by suction to the back wall of the vacuum reservoir 22. Simultaneously, because of the air flow, the touch check valve 24 opens, and the air is removed by suction. If the lifting suction device is intended to release again from the box carrier 14, then a brief blow-off impetus is given, which also presses a ball in the touch check valve 24 onto its seat again because of the change in the flow direction. There is now a vacuum in the box carrier 14.

At the outlet of the machine, five pneumatic cylinders 32, corresponding to the number of venting stations 26, are disposed in such a way that for the sake of simultaneous ventilating of five box carriers 14, they are located opposite the vacuum reservoirs 22. Upon actuation of the pneumatic cylinders 32, a cylinder rod 34 presses on the touch check valve 24 in the axial direction y from the back wall side of the vacuum reservoir 22 and presses the touch check valve inward by approximately 3 mm in the axial direction y. In this operation, an O-ring used as a sealing ring detaches from the inner wall of the vacuum reservoir 22, so that air flows into the vacuum reservoir 22 from outside. As a result of this ventilation of the vacuum reservoir 22, the boxes, contacting the contact surfaces 16 and held on the box carriers 14 by an underpressure, are detached from the box carriers 14.

Figure 2:
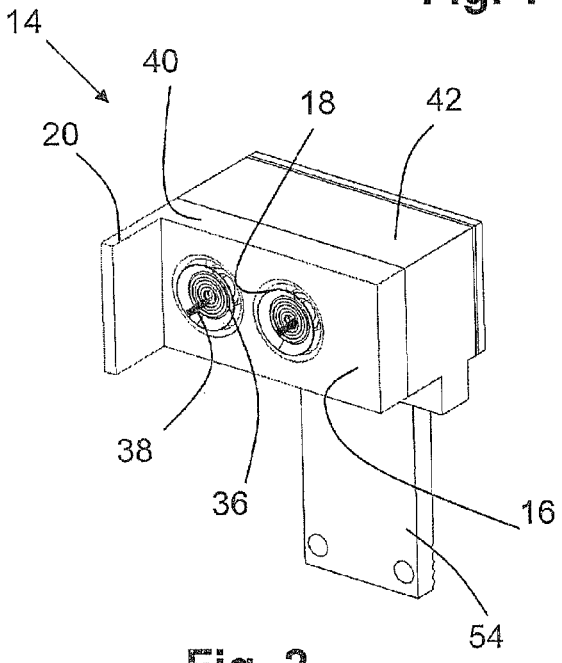
FIG. 2 shows an oblique view on the front side of a box carrier of FIG. 1 for sleeves, with two suction openings that have integrated touch valves.
Figure 3:
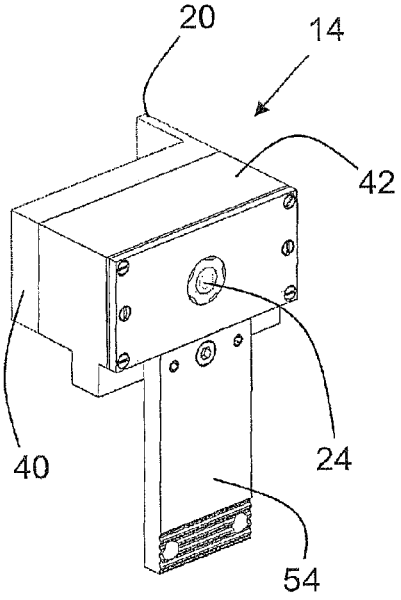
FIG. 3 is an oblique view on the back side of the box carrier of FIG. 2.

A box carrier 14 for sleeves, shown in FIGS. 2 and 3, has two suction openings 18. In each suction opening 18, there is one touch valve 36, with a feeler pin 38 protruding away from the vertical plane of the contact surface 16. When a sleeve or folding box is placed against the contact surface 16 and against the position stop 20 that protrudes at a right angle from the contact surface 16, only those feeler pins 38 that are covered by the folding boxes contacting them are pressed inward, thus opening the touch valves 36. When there is a large number of different formats, it can prove practical as a rule to provide a greater number of suction openings 18 over the contact surface 16.

Figure 4:
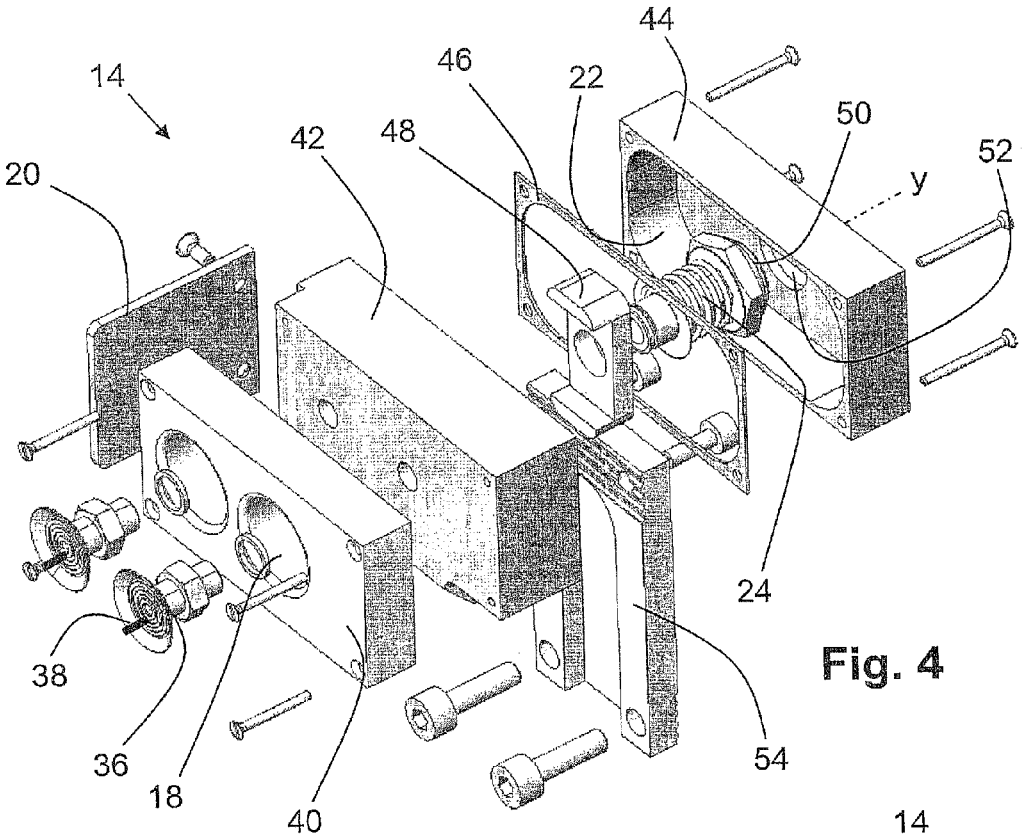
FIG. 4 shows an exploded view of the box carrier of FIG. 2.

The exploded view of FIG. 4 shows the construction of the box carrier 14 shown in FIGS. 2 and 3, with two suction openings 18, each with one touch valve 36 with a feeler pin 38, in a box carrier screen 40 screwed to a box carrier base plate 42. The position stop 20 embodied as a plate is screwed laterally to the box carrier base plate 42. A boxlike back wall part 44 is screwed to the base plate 42 via a flat seal 46 and forms the vacuum reservoir 22. Inside the vacuum reservoir 22, the touch check valve 24 is supported on one of its ends displaceably in the axial direction y in a valve holder 48, and with an O-ring seal 50 on its other end, it presses against the inner wall of the back wall part 44, which is provided with an opening 52. For securing the box carrier 14 to the circulating conveyor chain 12, a mounting 54 that can be screwed to the conveyor chain 12 protrudes downward from the base plate 42.

Figure 5:
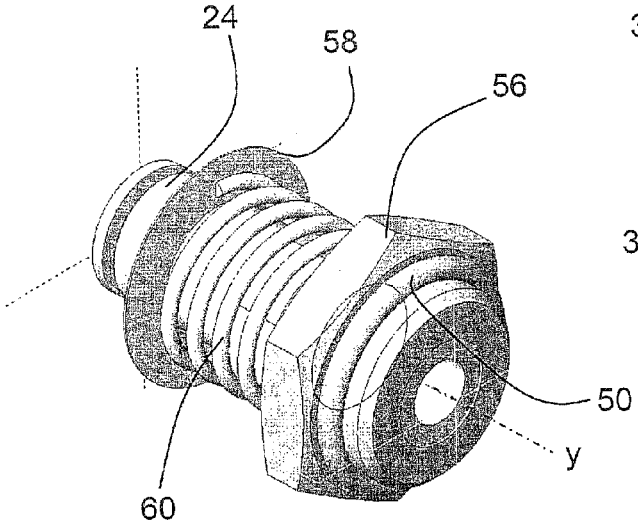
FIG. 5 is an enlarged oblique view on the touch check valve of FIG. 4.

The touch check valve 24, as shown in FIG. 5, is retained in a valve receptacle 56 that carries the O-ring seal 50, and for sliding support in the axial direction y it is inserted into the valve holder 48. A compression spring 60 is disposed between the valve receptacle 56 and a spring steel disk 58 that is provided for contact with the valve holder 48.

Figure 6:
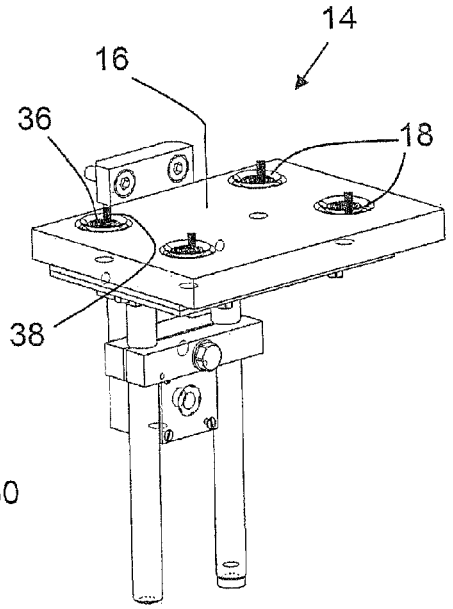
FIG. 6 shows an oblique view on a box carrier for flat blanks, with four suction openings that have integrated touch valves.

FIG. 6 shows a box carrier with a horizontally located contact surface 16 that has four suction openings 18.

Figure 7:
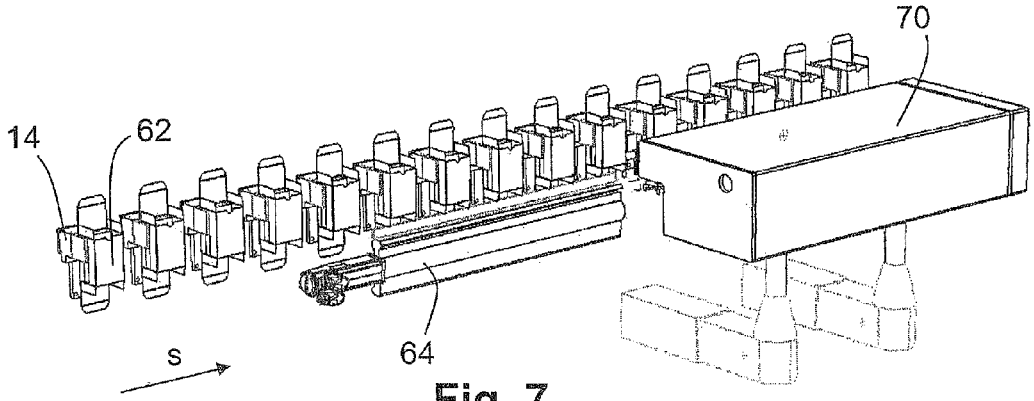
FIG. 7 shows an oblique view on a prekinking station and a closing station for sleeves.
Figure 8:
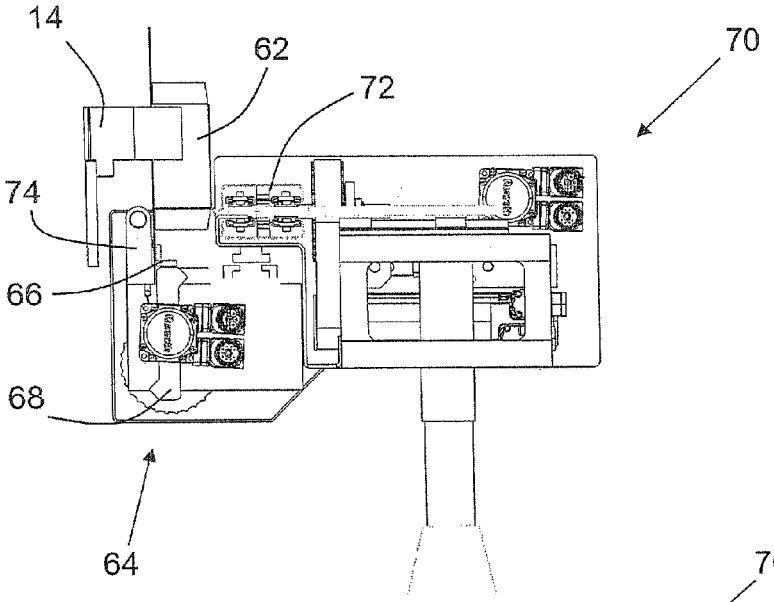
FIG. 8 is a side view in section of the arrangement of FIG. 7, looking in the direction s.
Figure 9:
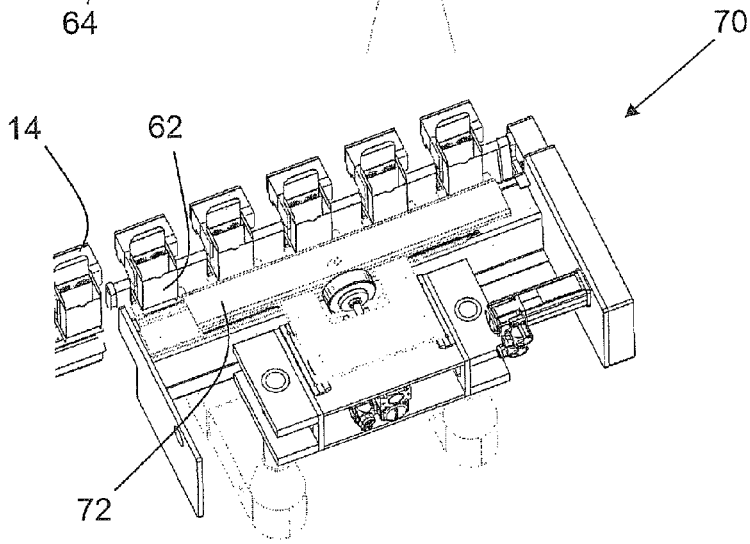
FIG. 9 shows an oblique view on the closing station of FIG. 7, which is open at the top.

The devices shown in FIGS. 7 through 9 serve to close the bottom of the folding boxes or sleeves 62, which are transferred from a top loader before they are filled. The box carriers 14, mounted on the conveyor chain 12 and having the folding boxes 62, are moved, for closure of the box bottom, successively past a prekinking station 64 and a closing station 70.

In the prekinking station 64, the bottom of the folding box is moved to a ledge 66, and a kink lever 68 kinks the insertion tab. Next, the chain conveyor moves the box carrier 14 into the closing station 70. There, a dust tab kinker 72 first moves outward and kinks tabs inward. Then a pivoting rake 74 closes the bottom from behind. At the same time, the dust tab kinker 72 moves inward again, and the bottom is closed completely by means of a guide plate with the pivoting rake 74. After that, the pivoting rake 74 moves back again.

With the exemplary embodiments described above, the following demands are met:

The system is suitable for boxes made from sleeves and/or flat blanks.

Replicable, fast format change (±0.5 mm) with as little possibility of adjustment by the human operator as possible.

High flexibility in terms of layout (inflow and outflow of material).

High box output (up to 300 pieces/minute).

The foregoing relates to the preferred exemplary embodiments of the invention, it being understood that other variants and embodiments thereof are possible within the spirit and scope of the invention, the latter being defined by the appended claims.

The invention claimed is:

1. A system for transporting open boxes along a direction of travel in a packaging machine, said system including a plurality of box carriers disposed in said packaging machine, each box carrier being movable along the direction of travel, each box carrier having at least one contact surface for contacting and supporting an open box, each box carrier having its own, separate dedicated vacuum reservoir permanently attached to said contact surface and movable therewith, each box carrier having at least one suction opening extending through said contact surface and fluidically connected to said vacuum reservoir for holding said box against said contact surface by suction as the box carrier is moving such that each box carrier maintains negative pressure on its own with the box carrier's separate dedicated vacuum reservoir.

2. The system as defined in claim 1, wherein the contact surface has a plurality of suction openings.

3. The system as defined in claim 1, wherein said system includes at least one venting station disposed along said direction for drawing a vacuum in each vacuum reservoir and at least one ventilating station disposed along said direction for relieving said vacuum in each vacuum reservoir, whereby as said each box carrier is transported along said direction, a valve on said box carrier is actuated by said venting station to create a vacuum in said reservoir for holding said box against said support surface, and actuated by said ventilation station to relieve vacuum in said reservoir for releasing said box from said support surface.

4. The system as defined in claim 3, wherein said valve is a touch check valve for sensing said venting or ventilating stations.

5. The system as defined in claim 3, wherein the contact surface has a plurality of suction openings.

6. The system as defined in claim 4, wherein the contact surface has a plurality of suction openings.

7. The system as defined in claim 1, wherein a position stop is provided on said contact surface.

8. The system as defined in claim 2, wherein a position stop is provided on said contact surface.

9. The system as defined in claim 3, wherein a position stop is provided on said contact surface.

10. A method for closing an open box, transported by a system as defined by claim 1, having the steps of closing the open box with a closing device while holding the open box against said contact surface with said at least one suction opening.

11. A method for closing an open box, transported by a system as defined by claim 2, having the steps of closing the open box with a closing device while holding the open box against said contact surface with said plurality of suction openings.

12. A method for closing an open box, transported by a system as defined by claim 3, having the steps of closing the open box with a closing device while holding the open box against said contact surface with said at least one suction opening.

13. A method for closing an open box, transported by a system as defined by claim 4, having the steps of closing the open box with a closing device while holding the open box against said contact surface with said at least one suction opening.

14. A method for closing an open box, transported by a system as defined by claim 5, having the steps of closing the open box with a closing device while holding the open box against said contact surface with said plurality of suction openings.

15. A method for closing an open box, transported by a system as defined by claim 6, having the steps of closing the open box with a closing device while holding the open box against said contact surface with said plurality of suction openings.

16. A method for closing an open box, transported by a system as defined by claim 7, having the steps of closing the open box with a closing device while holding the open box against said contact surface with said at least one suction opening.

17. A method for closing an open box, transported by a system as defined by claim 8, having the steps of closing the open box with a closing device while holding the open box against said contact surface with said plurality of suction openings.

18. A method for closing an open box, transported by a system as defined by claim 9, having the steps of closing the open box with a closing device while holding the open box against said contact surface with said at least one suction opening.

19. The system of claim 1, further comprising a conveyor, each of the plurality of box carriers being disposed on the conveyor, the conveyor configured to move the plurality of boxes along the direction of travel.

20. The system of claim 19, wherein the direction of travel includes direction along both a curved section of the conveyor and a straight section of the conveyor.

21. The system of claim 19, wherein the number of box carriers on the conveyor is equivalent to the number of boxes being moved along the direction of travel.

22. A system for transporting open boxes along a direction of travel in a packaging machine, said system including a plurality of box carriers disposed in said packaging machine, each box carrier being movable along the direction of travel, each box carrier having at least one contact surface for contacting and supporting an open box, each box carrier having its own, separate dedicated vacuum reservoir permanently attached to said contact surface and movable therewith, each box carrier having at least one suction opening extending through said contact surface and fluidically connected to said vacuum reservoir for holding said box against said contact surface by suction as the box carrier is moving, and wherein the vacuum reservoir includes a valve adapted to be activated for venting and ventilating said vacuum reservoir thereby holding or releasing said box from said contact surface.

* * * * *